US006182578B1

(12) United States Patent
Fanuzzi

(10) Patent No.: US 6,182,578 B1
(45) Date of Patent: Feb. 6, 2001

(54) PORTABLE TREATMENT TABLE

(76) Inventor: John M. Fanuzzi, Hwy. 89 Seven Point Ranch, Emigrant, MT (US) 59027

( * ) Notice: Under 35 U.S.C. 154(b), the term of this patent shall be extended for 0 days.

(21) Appl. No.: 09/462,313

(22) PCT Filed: Jul. 1, 1998

(86) PCT No.: PCT/US98/13647

§ 371 Date: Jan. 6, 2000

§ 102(e) Date: Jan. 6, 2000

(87) PCT Pub. No.: WO99/02068

PCT Pub. Date: Jan. 21, 1999

Related U.S. Application Data

(60) Provisional application No. 60/052,178, filed on Jul. 10, 1997.

(51) Int. Cl.[7] ..... A47B 3/00
(52) U.S. Cl. ..... 108/36; 108/132
(58) Field of Search ..... 108/34, 35, 36, 108/115, 130, 131, 132, 133

(56) References Cited

U.S. PATENT DOCUMENTS

| | | | | |
|---|---|---|---|---|
| 439,954 | * | 11/1890 | Jackson | 108/131 |
| 3,357,729 | * | 12/1967 | Krueger | 108/130 |
| 4,333,638 | * | 6/1982 | Gillotti | 108/36 |
| 4,833,998 | * | 5/1989 | Everett et al. | 108/36 |
| 4,927,128 | * | 5/1990 | O'Brian | 108/36 |
| 4,943,041 | * | 7/1990 | Romein | 108/36 |
| 5,009,170 | * | 4/1991 | Spehar | 108/36 |
| 5,325,793 | * | 7/1994 | Martin | 108/130 |
| 5,943,965 | * | 8/1999 | Riach et al. | 108/36 |
| 5,974,979 | * | 11/1999 | Grady et al. | 108/36 |
| 6,000,345 | * | 12/1999 | Gillotti | 108/36 |
| 6,076,472 | * | 6/2000 | Lloyd | 108/36 |

* cited by examiner

*Primary Examiner*—Janet M. Wilkens
*Assistant Examiner*—Jerry A. Anderson
(74) *Attorney, Agent, or Firm*—Dennis A. Bennett

(57) ABSTRACT

There is disclosed a portable treatment table (10) with a truss suspension system (44, 46, 60, 62, 100, 130). The table is lightweight and able to handle heavy loads.

5 Claims, 2 Drawing Sheets

PORTABLE TREATMENT TABLE

This application is a 371 of PCT/US98/13647 filed Jul. 1, 1998 and also claims the benefit of Provisional Application Ser. No. 60/052,176 filed Jul. 10, 1997.

BACKGROUND OF THE INVENTION

1. Field of the Invention

The invention relates to folding tables in general, and specifically to portable tables for use in massage or therapeutic body work such as for the chiropractic art.

2. Related Art

The art teaches a wide variety of special purpose folding tables for use in applications such as massage, therapy, chiropractic arts, article display, and beauty treatment as well as folding tables for general purpose use.

U.S. Pat. Nos. 5,335,676; 5,009,170 and 4,943,041 disclose varying truss suspension systems for portable tables.

U.S. Pat. No. 4,927,128 discloses a sliding leg body-work table including a channel system which provides support for the table legs and rotatable diagonal braces which extend from a cross tube for connecting each leg pair to the table surface. A system of wire ropes support the central hinged end of the table top sections and operate in conjunction with diagonal braces for locking of the legs in an operational position.

U.S. Pat. No. 4,333,638 to Gilloti discloses a table with a truss suspension system having legs hinge from the ends of the table and diagonal braces extending from the center of the table to attach onto the table legs. The truss system consists of a cord member of wire rope or flexible material attached to the lower end of the legs and extending the full length of the table parallel to the table surface. Users regard this type of table as unsatisfactory because the position of the cable interferes with the movement of the user and required the user to connect and disconnect the diagonal braces on one or both ends on setting up or collapsing the table.

Another type of folding table is disclosed in U.S. Pat. No. 3,357,729 to Krueger, consisting of a collapsible table with strap-like brace members having folding legs at each end. This type of table does not have a support cable system attached to the legs, nor does it provide a strong working platform, and tends to be noisy when rocking forces are applied thereto. Also this type of table requires some skill and training on the part of its user to set up and collapse, and provides limited means to adjust height dimension of the working surface.

SUMMARY OF THE INVENTION

The present invention is a special purpose table for use in massage or other body work such as the chiropractic arts. The table is able to fold in half and the legs and support cables are stored within the space between the two halves of the folded sections. When folded the table is easily able to be carried by one person where it is needed. The novel x-frame and support cable design offers a lightweight yet very stable table.

It is an object of the present invention to provide a folding table having a new and unique support structure that overcomes the problems found in prior art tables. The present invention allows for knee room under the table, yet be stable and easy to set-up.

It is still another object of the present invention to provide a portable treatment table that is safer in operation with a triangular bracing system less likely to fail and offer greater stability for the supported structure.

It is an advantage of the this novel portable table in that there are fewer cables and has a less complex design than disclosed in the art.

Another advantage of the present invention is the reduced weight due to the ability to use plastic and other lightweight material.

These, together with the various ancillary objects and features of the instant invention which will become apparent as the following description proceeds, are attained by this folding, portable massage table as disclosed herein, preferred embodiments thereof being shown in the accompanying drawings, by way of example only.

DETAILED DESCRIPTION OF THE PREFERRED EMBODIMENTS

Figure 1:
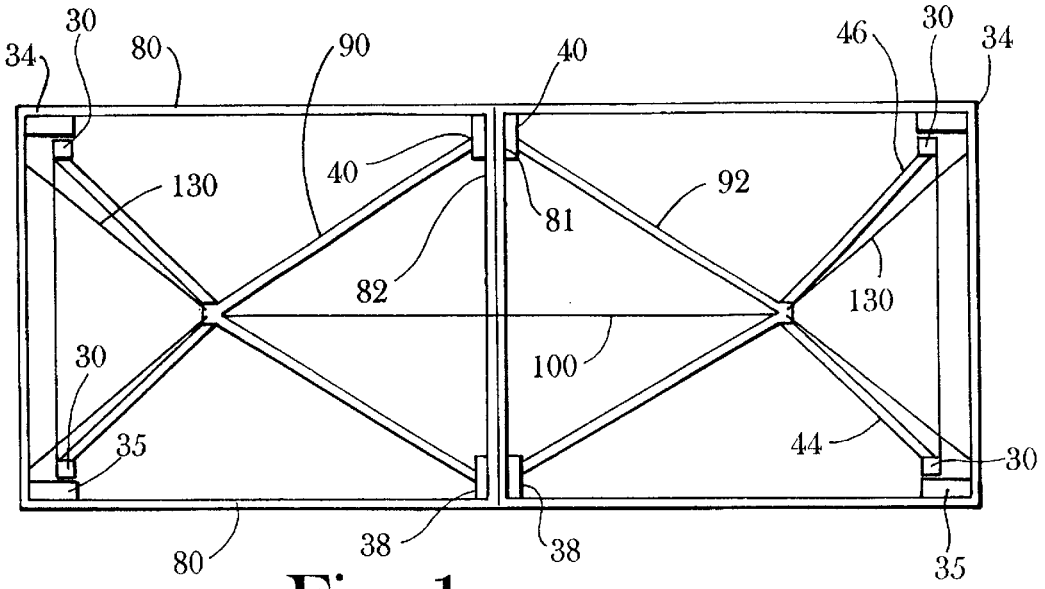
FIG. 1 is bottom view of the claimed table shown in an assembled condition.
Figure 2:
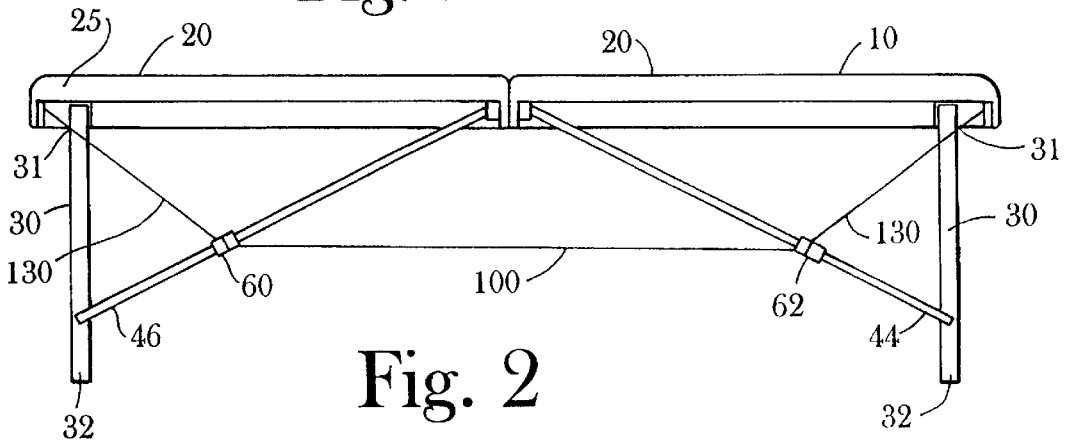
FIG. 2 is a side view of the table shown in FIG. 1 with perimeter frame rail 80 removed to show outer corners 34 and 35.
Figure 3:
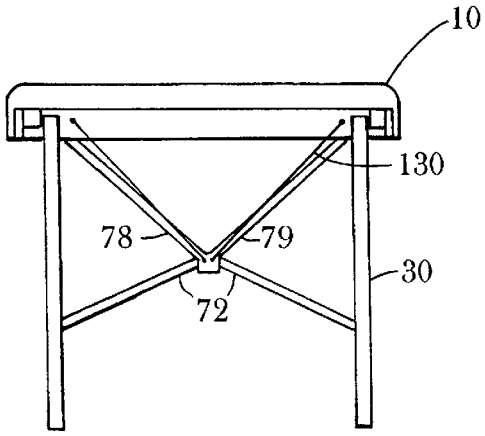
FIG. 3 is an end view of the table shown in FIG. 1.

As shown in FIGS. 1, 2 and 3, a portable folding treatment table 10 comprises two rectangular flat table top sections 20 each of which contains, on its under surface a perimeter frame rail 80 anchored or attached to top sections 20 with glue, nails or angle brackets or the like. Sections 20 are abutted and connected by hinges or hinge members attached to the bottom surface of abutting perimeter frame rail 81 and 82. It will be apparent that these hinge members may be replaced with a single hinge running substantially the length of the abutting perimeter frame rails. Sections 20 and perimeter frame rail 80 are covered with cushion pads 25. At the outer corners 34 and 35 of each section 20 a pair of support legs 30 is attached at the top of the support legs 31 by hinge or a first pivot means. Preferably the support legs 30 are adjustable for height. Each outer pair of support legs 30 are optionally connected together by a brace or cable (not shown) or the like.

Each section 20 has x-frames 90 and 92 secured to the inner corners 38 and 40 by the use of hinges, pivot means or the like. The bottom of the x-frames 44 and 46 are secured to the second end or bottom end 32 of support legs 30 by the use of hinges, pivot means or the like. Each x-frame 90 and 92 has a hinged center portion 60 and 62. The hinged center portions 60 and 62 have a locking mechanism that keeps the x-frame in a single plane. In the preferred embodiment, the locking mechanism is a pair of flexible, non-stretchable cables 130, which are secured to the outer corners 34, 35 or alternatively attached at the top of the support legs 31 and to the center hinges 60 and 62. Alternatively cables 130 may be two separate cables attached to one of the outer corners 34 and 35 and to the hinged center portion 60 and 62 of the x frame 90 and 92. The cables 130 being of such length to be in tension when the table top sections 20 are coplanar and when the legs are fully unfolded as shown in FIG. 1. Cables 130 keep the x frames 90 and 92 in a planar position but also provide additional support for the table 10.

Figure 4:
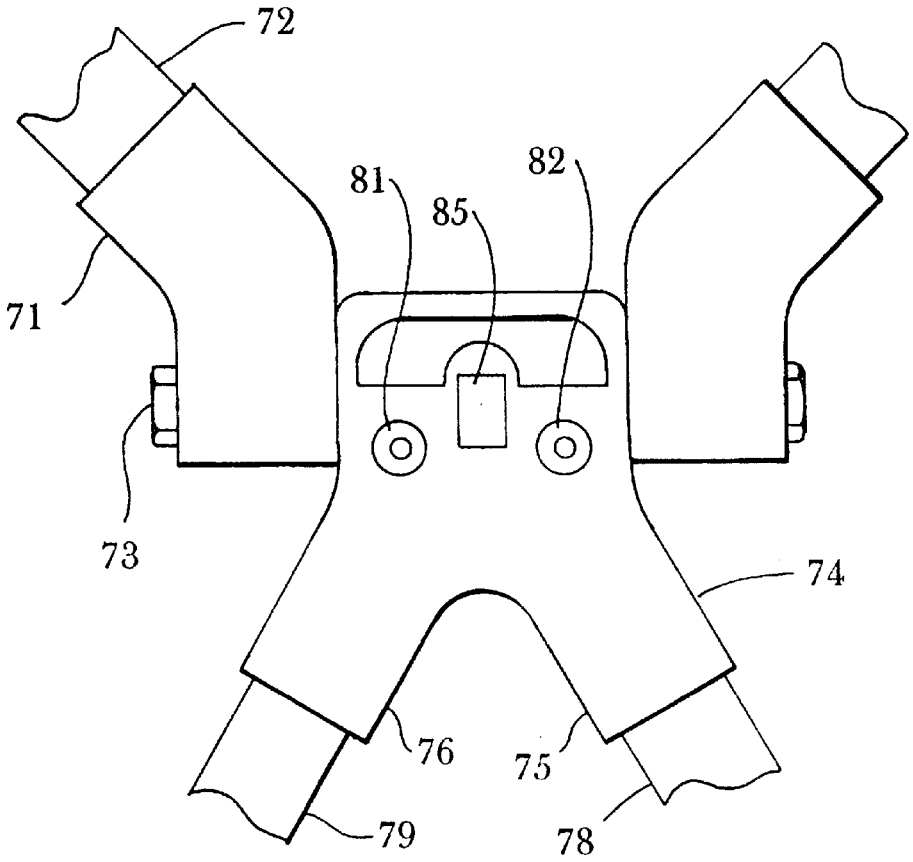
FIG. 4 is a front view of a preferred hinge portion of the disclosed X frame.

A center flexible, non-stretchable cable or first cable 100 is secured to the x-frames 90 and 92 preferably by attaching the first end to the hinged center portion 60 and the second end to the hinged center portion 62. The cable 100 being of such length to be in tension when said table top sections are coplanar and when said legs 30 are fully unfolded as shown in FIG. 1. Unlike other tables in the art, the preferred table has no need for a means to have this cable "retracted" when the table is folded. In an another embodiment, the first cable 100 can be two separate cables each having one end attached to one the hinged center portion 60 or 62 and the other end attached to an opposite outer corner in a criss-cross manner In FIG. 4 there is disclosed a preferred hinged center portion 60 or 62. The hinge 60 or 62 is made of injection molded high impact nylon. The center hinges 60 or 62 have nylon rod or struts ends 71 which are capable of receiving struts 72. The rod ends 71 are ribbed internally to accept and retain struts.

Figure 5:
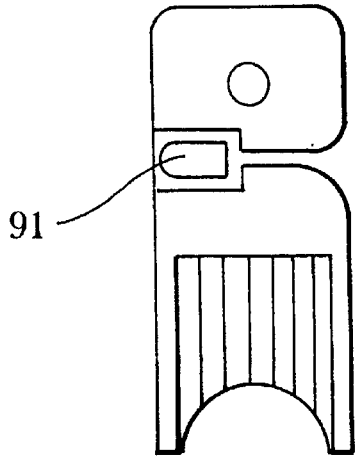
FIG. 5 is a cut away cross view of the stop end used in the preferred hinge portion shown in FIG. 4.

Bolt holes are drilled or molded in strut end 71 to accept bolt 73. Y shaped dual strut end 74 has strut ends 75 and 76 which accepts struts 78 and 79. Each strut end 75 and 76 are ribbed internally to accept and retain struts having varying degrees of tolerance. In the preferred embodiment pouring of the hinged center portion 60 or 62 is done on the inside to maintain uniformity in the outer wall and to reduce cycle time of the injection process. The top of dual strut end 74 is capable of accepting bolt 73 and has cable stop sleeves receptacle 81 and 82 capable of receiving cable stop 91 as shown in FIG. 5. Stop end sleeve 85 retains receives the stop end of cable 100. Stop end sleeve edges are rounded to prevent wear on the cables 130.

All U.S. patents disclosed are hereby incorporated by reference as if written herein in their entirety.

From the foregoing description, one skilled in the art can easily ascertain the essential characteristics of this invention, and without departing from the spirit and scope thereof, can make various changes and modifications of the invention to adapt it to various usages and conditions. Accordingly the scope of the invention is not to be considered limited to the particular embodiments shown or suggested, but is rather to be determined by reference to the appended claims.

What is claimed:

1. A portable table, comprising:

a rectangular table top composed of a pair of abutting table top sections hingably secured to enable said abutting table top sections to fold together in a collapsed condition /so that their undersurfaces /face each other and said abutting table top sections are coplanar when unfolded, each of said pair of abutting table top sections having a perimeter frame rail integral with each of said table top sections, and a pair of first and second inner corners and a pair of first and second outer corners;

two pairs of support legs each leg having a first end and a second end, said first end of each support leg being hingably secured to an outer corner of said abutting table top sections;

a pair of x-frames, each x-frame having a first top end and a second top end, a hinged center portion and a first bottom end and a second bottom end, said first top end and second top end of each x-frame being hingably secured to said pair of inner corners of said pair of abutting table top sections, said first bottom end and second bottom end of each x-frame being hingably secured to said second end of said pair of support legs;

a first cable having a first end and a second end, said first end of said first cable secured to one of said x-frames and said second end of said first cable secured to the other x-frame, said first cable being of such length to be in tension when said abutting table top sections are coplanar and where each of said two pairs of support legs are unfolded; and a locking mechanism capable of securing / said x frame in a single plane when said table is unfolded.

2. The table as recited in claim 1 further comprising a brace secured between each of said pair of support legs.

3. The table as recited in claim 1 wherein said locking mechanism comprises two pair of second cables, each having a first end, and a second end, said first end of each of second cables secured to an outer corner of said abutting table top sections and said second end of each of second cables being secured to each of said hinged center portion of each of said x-frames, each of said second cables being of such length to be in tension when said abutting table top sections are coplanar and where each of said two pairs of support legs are unfolded.

4. The table as recited in claim 1 wherein said locking mechanism comprises a pair of second cables, each having a first end, middle portion and a second end, said first end of each pair of second cables secured to /said outer corner of said abutting table top sections, said middle portion of each of said pair of second cables secured to each of said hinged center portion of each of said x-frames, said second end of each pair of second cables being secured to the /opposite outer corner of each abutting table top sections, each said pair of second cables being of such length to be in tension when said abutting table top sections are coplanar and where each of said two pairs of support legs are unfolded.

5. The table as recited in claim 1 wherein said first end and said second end of said first cable are secured to said hinged center portions of said x-frames.

* * * * *